US011768467B2

(12) United States Patent
Hurni et al.

(10) Patent No.: US 11,768,467 B2
(45) Date of Patent: Sep. 26, 2023

(54) WATCH COMPRISING A WATCH CASE PROVIDED WITH TWO DIALS

(71) Applicant: Montres Jaquet Droz SA, La Chaux-de-Fonds (CH)

(72) Inventors: David Hurni, La Chaux-de-Fonds (CH); Philippe Willemin, Bassecourt (CH)

(73) Assignee: Montres Jaquet Droz SA, La Chaux-de-Fonds (CH)

( * ) Notice: Subject to any disclaimer, the term of this patent is extended or adjusted under 35 U.S.C. 154(b) by 1163 days.

(21) Appl. No.: 16/299,188

(22) Filed: Mar. 12, 2019

(65) Prior Publication Data

US 2019/0286057 A1 Sep. 19, 2019

(30) Foreign Application Priority Data

Mar. 13, 2018 (EP) ..... 18161498

(51) Int. Cl.

| | |
|---|---|
| ***G04B 19/14*** | (2006.01) |
| ***G04B 19/12*** | (2006.01) |
| ***G04B 45/00*** | (2006.01) |
| ***G04B 37/04*** | (2006.01) |
| ***G04B 19/02*** | (2006.01) |
| ***G04B 19/06*** | (2006.01) |

(52) U.S. Cl.

CPC ..... *G04B 19/14* (2013.01); *G04B 19/025* (2013.01); *G04B 19/065* (2013.01); *G04B 19/12* (2013.01); *G04B 37/04* (2013.01); *G04B 45/0069* (2013.01)

(58) Field of Classification Search

CPC ..... G04B 19/12; G04B 19/14

See application file for complete search history.

(56) References Cited

U.S. PATENT DOCUMENTS

| | | | | |
|---|---|---|---|---|
| 5,184,333 | A * | 2/1993 | Caspar | G04B 19/23 368/28 |
| 2005/0207283 | A1 * | 9/2005 | Loth | G04B 19/23 368/223 |
| 2007/0140063 | A1 | 6/2007 | Shu | |

(Continued)

FOREIGN PATENT DOCUMENTS

| | | |
|---|---|---|
| CH | 218931 | 1/1942 |
| CH | 712 989 A1 | 3/2018 |
| CN | 102939569 A | 2/2013 |

(Continued)

OTHER PUBLICATIONS

Combined Chinese Office Action and Search Report dated Feb. 9, 2021 in Chinese Patent Application No. 201910189000.3 (with partial English translation), 11 pages.

(Continued)

*Primary Examiner* — Edwin A. Leon
*Assistant Examiner* — Jason M Collins
(74) *Attorney, Agent, or Firm* — Oblon, McClelland, Maier & Neustadt, L.L.P.

(57) ABSTRACT

The invention concerns a watch 1 comprising a watch case 2, the watch case 2 containing a watch movement 6 and two dials 8*a*, 8*b*. The watch 1 further includes a casing ring 3 arranged inside the watch case 2, the watch movement 6 being mounted in the casing ring 3 so as to be suspended in a cantilever arrangement inside the watch case 2, said casing ring 3 supporting the two dials 8*a*, 8*b*.

10 Claims, 4 Drawing Sheets

(56) References Cited

U.S. PATENT DOCUMENTS

| | | | | |
|---|---|---|---|---|
| 2012/0287762 | A1 | 11/2012 | Mintiens | |
| 2015/0253735 | A1* | 9/2015 | Watterson | G04G 21/025 368/10 |

FOREIGN PATENT DOCUMENTS

| | | | |
|---|---|---|---|
| CN | 204331300 | U | 5/2015 |
| FR | 2 785 689 | A1 | 5/2000 |
| JP | 9-127264 | | 5/1997 |
| JP | 9-127264 | A | 5/1997 |

OTHER PUBLICATIONS

European Search Report dated Oct. 29, 2018 in European Application 18161498.3 filed on Mar. 13, 2018 (with English Translation of Categories of cited documents).
Chinese Office Action dated Jun. 9, 2021 in Chinese Patent Application No. 201910189000.3 , 3 pages.
Combined Chinese Office Action and Search Report dated Jul. 23, 2020 in Chinese Patent Application No. 201910189000.3 (with unedited computer generated English translation of Office Action), 12 pages.
Indian Office Action dated Oct. 22, 2020 in Indian Patent Application No. 201944009048.

* cited by examiner

WATCH COMPRISING A WATCH CASE PROVIDED WITH TWO DIALS

CROSS-REFERENCE TO RELATED APPLICATION

This application claims priority to European Patent Application No. 18161498.3 filed on Mar. 13, 2018, the entire disclosure of which is hereby incorporated herein by reference.

FIELD OF THE INVENTION

The invention concerns a watch comprising a watch case containing a watch movement and two dials.

BACKGROUND OF THE INVENTION

In the field of mechanical or electromechanical watches, it is known to provide two dials inside the watch case. The two dials serve, for example, to display the time in two different time zones at the same time. Alternatively, a first dial can be used to display the time, while a second dial serves as ornamental decoration for the watch. However, the dial assembly operation in the watch case may be complex and inconvenient for an operator responsible for assembling the watch. Further, adjustment of the position of one dial relative to the other can be made difficult by the limited space available inside the watch case.

There are also known watch movements suspended inside a watch case.

Such a watch provided with a suspended watch movement is, for example, disclosed in Japanese Patent No JP H09127264. The watch includes a watch case containing a support frame, a watch movement, an ornamental part and a dial. The support frame is fixed inside the watch case, and the watch movement is mounted in an opening in the frame so as to be suspended inside the watch case. The ornamental part is also mounted in another opening in the frame, and the dial is arranged on an upper surface of the support frame, covering the movement and surrounding the ornamental part via a corresponding opening made in the dial. However, the proposed watch has only one dial, and thus does not allow two dials to be arranged inside the watch case.

SUMMARY OF THE INVENTION

It is thus an object of the invention to provide a watch having a suspended watch movement and two dials, which facilitates assembly of the dials inside the watch case, and precisely positions the dials with respect to one another.

To this end, the invention concerns a watch, which includes the features mentioned in the independent claim 1.

Specific embodiments of the watch are defined in the dependent claims.

One advantage of such a watch according to the invention lies in the use of a casing ring to support the two dials, wherein the watch movement is mounted so as to be suspended in a cantilever arrangement inside the watch case. This single casing ring allows the dials to be precisely positioned with respect to one another. Assembly of the dials inside the watch case is therefore facilitated. Further, because the watch movement is mounted in the casing ring and the ring has small thickness, much of the space inside the watch case is left free. This offers a large possible decoration area for one of the two dials or allows three dimensional decorations to be added to the watch.

According to a first embodiment of the invention, the two dials have upper surfaces and the casing ring is shaped such that the upper surfaces of the two dials are coplanar.

According to a second embodiment of the invention, both dials have upper surfaces and the casing ring is shaped such that the upper surfaces of the two dials are located at different heights inside the watch case.

According to a preferred embodiment of the invention, one of the two dials circumscribes the other dial inside the watch case. This gives the watch a particularly interesting aesthetic look.

According to a particular example embodiment of the invention, the watch case is provided with a case middle and means for securing the casing ring to the case middle.

Advantageously, the securing means are screws positioned on the edge of the casing ring, one of the two dials being arranged on the casing ring and being provided on its edge with notches for receiving screw heads, such that said screws at the same time secure said dial to the casing ring. This facilitates the attachment of all the parts inside the watch case. Further, a similar principle of attachment can advantageously be used to allow three dimensional decorations to be secured in the empty space inside the watch case. The decorations are thus secured to the casing ring at the same time that the ring itself is secured to the case middle.

BRIEF DESCRIPTION OF THE DRAWINGS

The objects, advantages and features of the watch according to the invention will appear more clearly in the following description, based on at least one non-limiting embodiment illustrated by the drawings, in which.

DETAILED DESCRIPTION OF THE INVENTION

Figure 1:
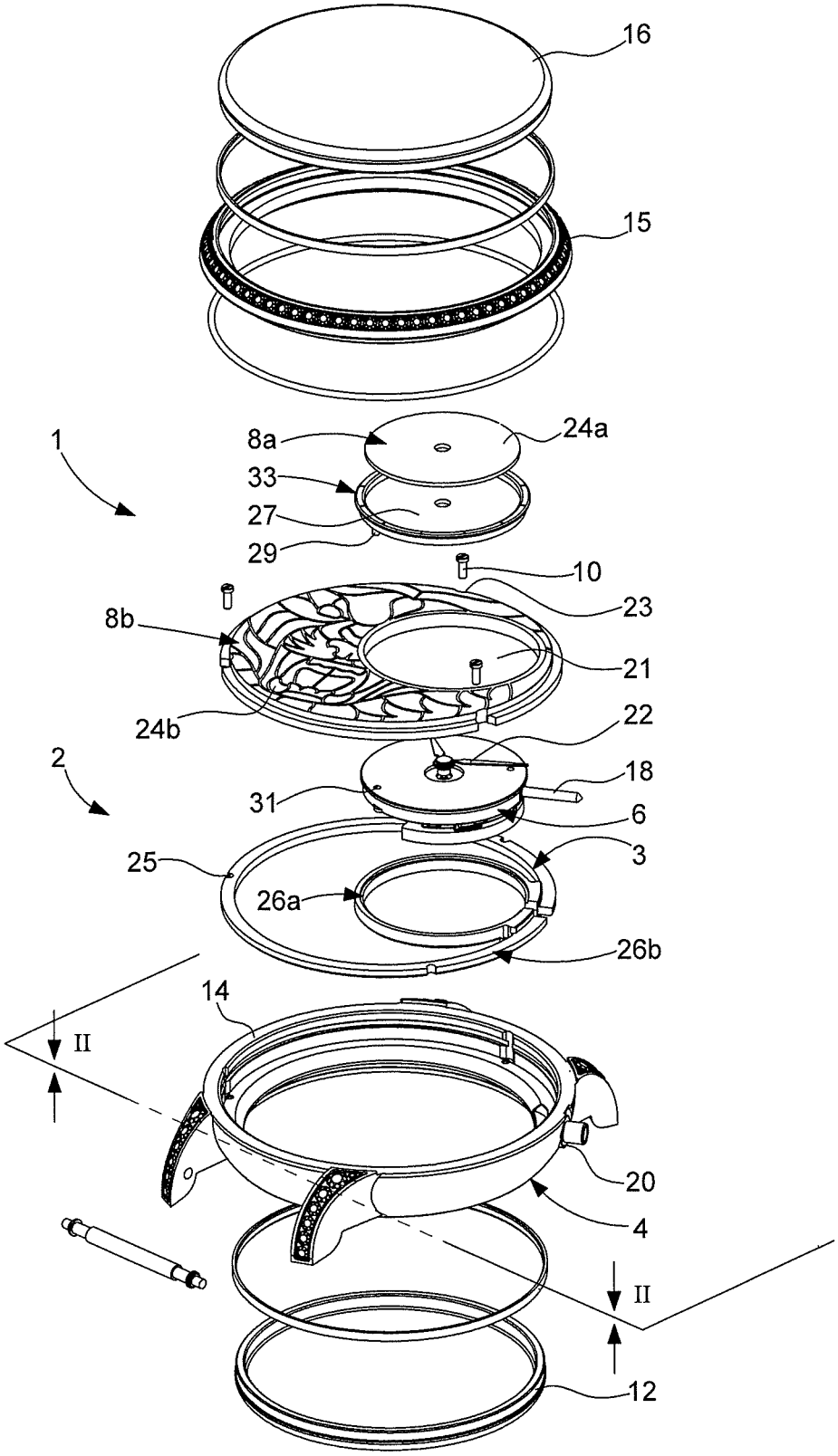
FIG. 1 is an exploded perspective view of the watch case of a watch according to the invention, the watch case comprising a casing ring.

FIG. 1 represents a watch 1 provided with a watch case 2. Watch 1 further includes a casing ring 3 arranged inside watch case 2.

Watch case 2 typically includes a case middle 4. Watch case 2 also contains a watch movement 6 and two dials 8*a*, 8*b* arranged inside case middle 4. Preferably, watch case 2 further includes means 10 for securing casing ring 3 to case middle 4.

Figure 4:
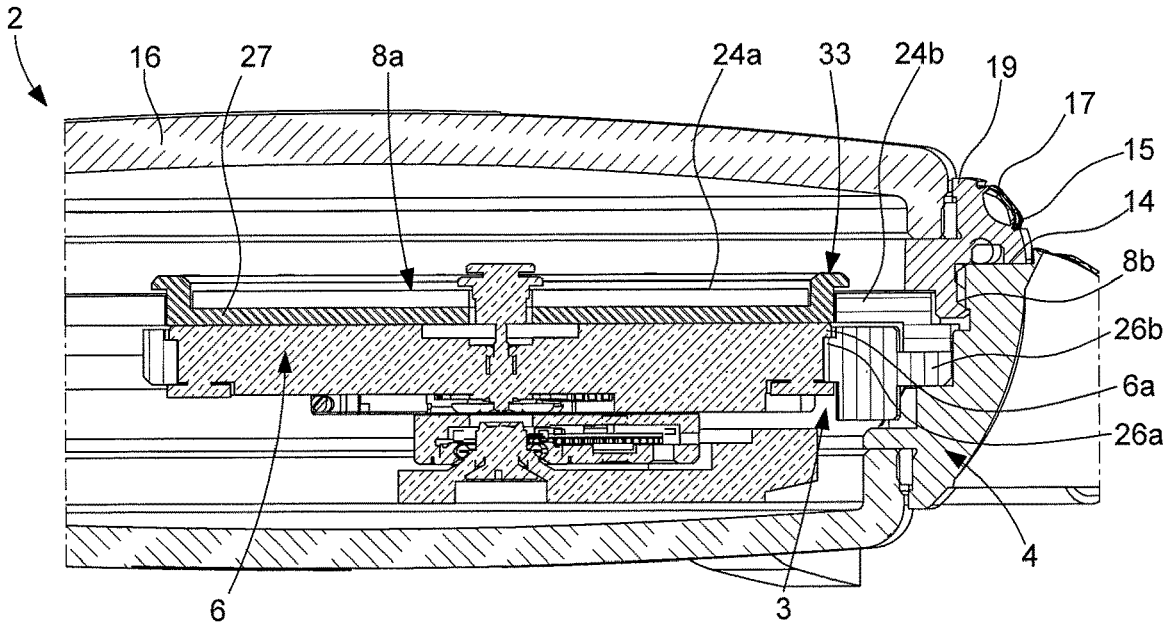
FIG. 4 is a sectional view of the watch case of FIG. 3 in which the parts omitted from FIG. 3 have been added back in, taken along a sectional plane IV-IV.

As illustrated in FIG. 1, case middle 4 is of annular shape and is placed on a case back 12 formed, in this example, by a first crystal (not represented). Case middle 4 is also provided with an annular upper rim 14 on which a bezel 15 rests. As illustrated in FIG. 4, bezel 15 is screwed onto case middle 4, from the top of the latter. A second crystal 16 is fixed in bezel 15, by means of a gasket 17 and an upper rim 19 of bezel 15; these two elements are visible in FIG. 4. In the watch case 2 taken as an example in FIGS. 1 to 4, the configuration of the watch case is substantially circular. However, the invention is not limited to this watch case configuration, or to the other arrangements described above for case middle 4.

Figure 2:
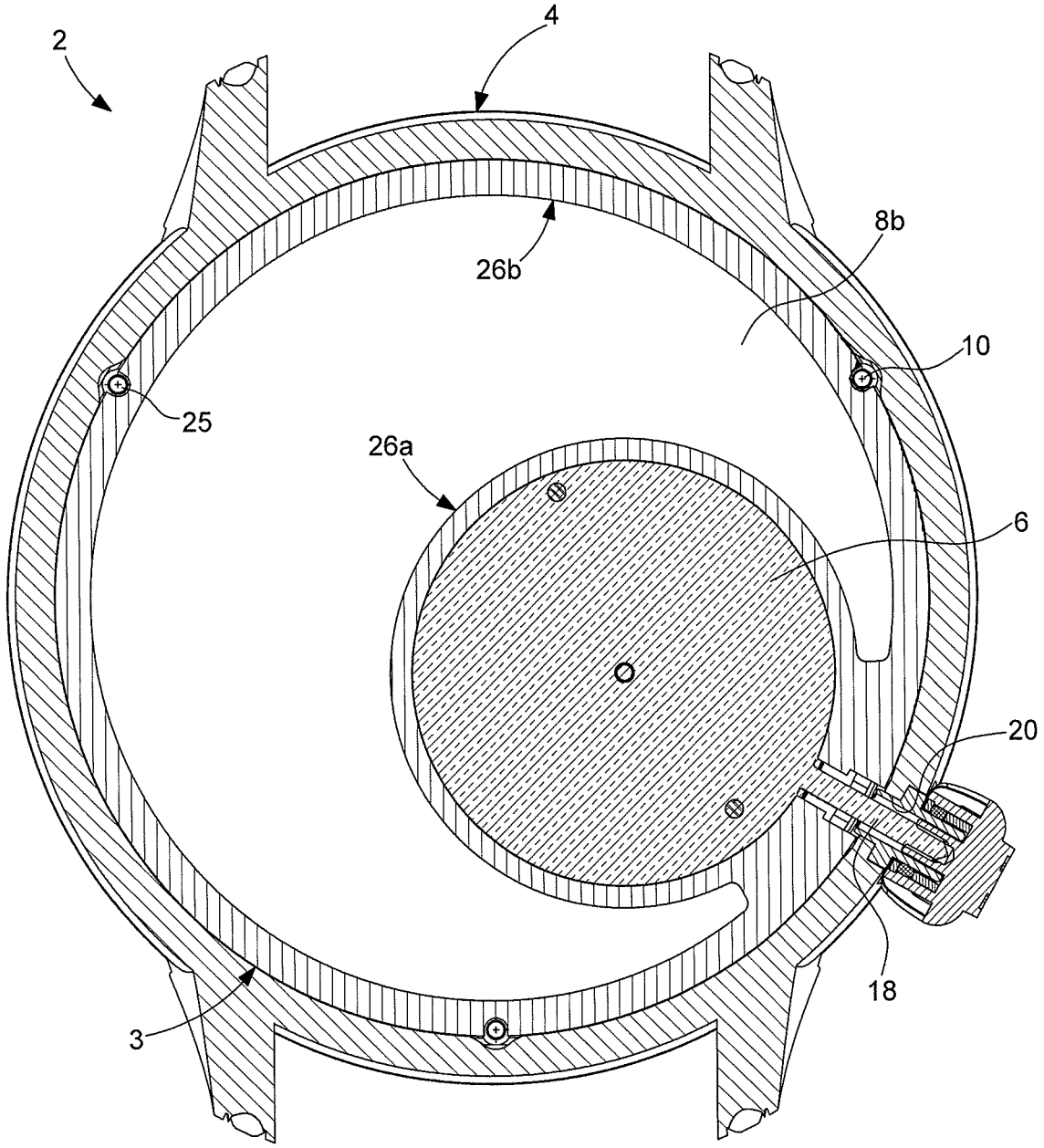
FIG. 2 is a sectional bottom view of the watch of FIG. 1 once assembled, taken along a sectional plane II-II.
Figure 3:
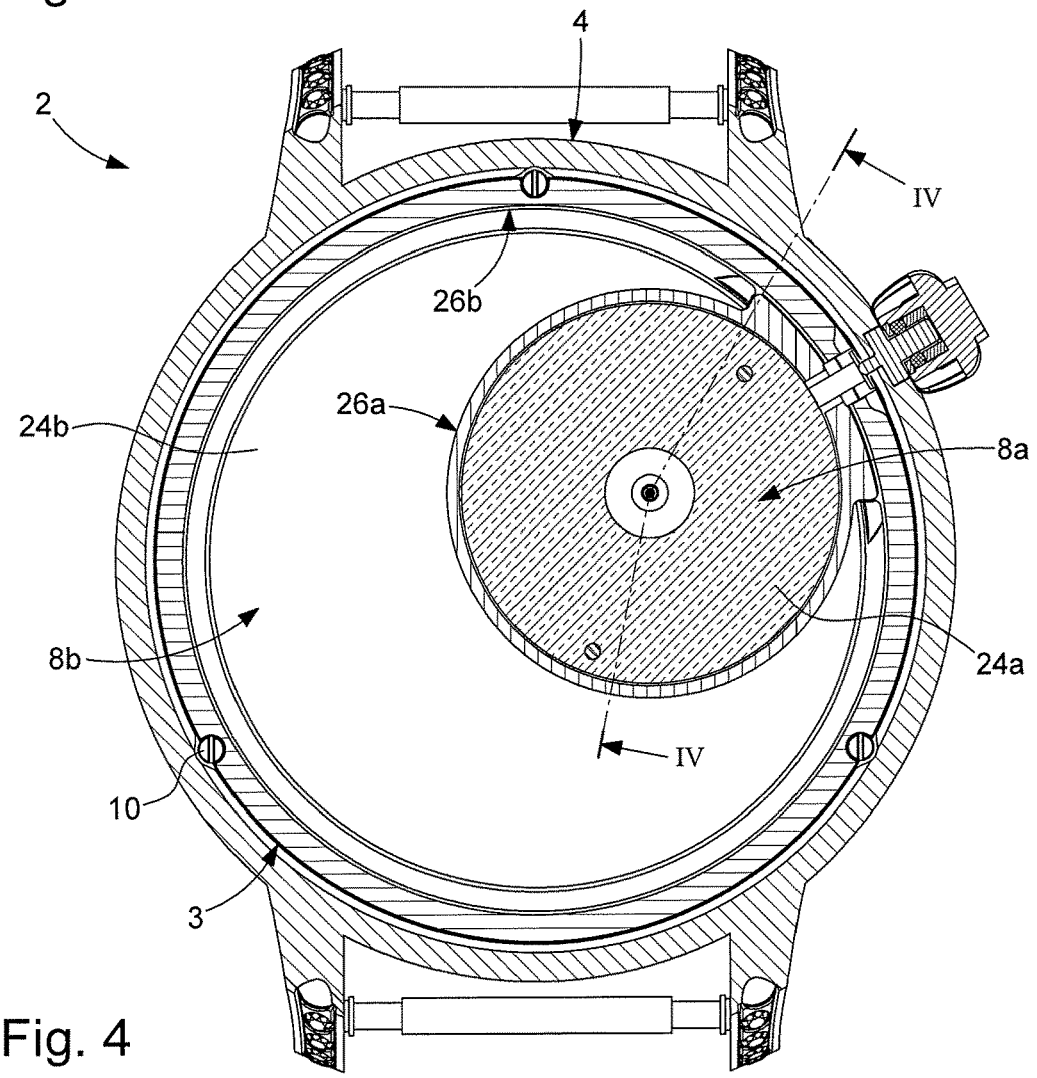
FIG. 3 is a sectional top view of the watch case of FIG. 1 from which some parts have been omitted, taken along sectional plane II-II.

As illustrated in FIGS. 1, 2 and 4, watch movement 6 is mounted in casing ring 3 so as to be suspended in a cantilever arrangement inside watch case 2. Watch movement 6 is typically a mechanical movement of circular shape, although this not limiting in the context of the present invention. Watch movement 6 includes a winding stem 18 which extends outside watch case 2 through an orifice 20 arranged in case middle 4.

In the example embodiment illustrated in FIGS. 1 to 4, a first dial 8*a* is a time dial used to display the time, above which move display means, formed of hands 22, coupled to watch movement 6. The first dial 8*a* is, for example, made of mother-of-pearl, although this is not limiting in the context of the present invention. A second dial 8*b* is, for example, a decorative dial, particularly a plique-à-jour. In this particular example embodiment, second dial 8*b* circumscribes first dial 8*a* inside watch case 2. To achieve this, second dial 8*b* is, for example, provided with an aperture 21 whose shape corresponds to the external shape of first dial 8*a*, typically a circular aperture 21 of substantially the same diameter as the external diameter of first dial 8*a* in the illustrative example of FIGS. 1 to 4. In other embodiments, not represented in the Figures, first dial 8*a* can circumscribe second dial 8*b* inside watch case 2.

Preferably, means 10 for securing casing ring 3 to case middle 4 are screws positioned on the edge of casing ring 3. Casing ring 3 supports the two dials 8*a*, 8*b*. One of dials 8*a*, 8*b* arranged on casing ring 3, for example, second dial 8*b* in the illustrative example of FIG. 1, is provided on its edge with corresponding notches 23, for receiving screw heads 10. Casing ring 3 is preferably also provided on its edge with notches 25 for receiving screws 10. Screws 10 thus also allow dial 8*b* to be secured to casing ring 3, at the same time that casing ring 3 is secured to case middle 4.

The two dials 8*a*, 8*b* have upper surfaces 24*a*, 24*b*. In a first embodiment, represented in FIGS. 1 to 6, casing ring 3 is shaped such that upper surfaces 24*a*, 24*b* of the two dials 8*a*, 8*b* are coplanar. In a particular exemplary variant of the first embodiment, illustrated in FIGS. 1 to 6, casing ring 3 includes two concentric integral rings 26*a*, 26*b*. As illustrated in FIG. 4, watch movement 6 is mounted in a first inner ring 26*a* which supports first dial 8*a*. For this purpose, watch movement 6 includes, for example, a peripheral collar 6*a* which rests on a rim of first inner ring 26*a*.

First dial 8*a* is mounted on top of first inner ring 26*a*, on watch movement 6 via a flange 27. First dial 8*a* is fixed to flange 27, for example by adhesive bonding. Flange 27 includes several dial pins/feet 29, one of which is visible in FIG. 1, projecting from a lower surface of the flange. Pins 29 of flange 27 are inserted into corresponding housings 31 of watch movement 6, allowing flange 27 to be secured to movement 6. Flange 27 is also provided with a peripheral rim extending through aperture 21 and bearing a collar 33. As illustrated in FIG. 4, collar 33 of flange 27 rests on second dial 8*b* and covers part of second dial 8*b* at the edge of its aperture 21. This makes it possible to give watch 1 a particular aesthetic look, particularly by concealing the gap between the two dials 8*a*, 8*b*.

A second outer ring 26*b* supports second dial 8*b*. Casing ring 3 is formed of a single piece of machined material, for example, a metal material. The metal material is typically stainless steel.

Figure 5:
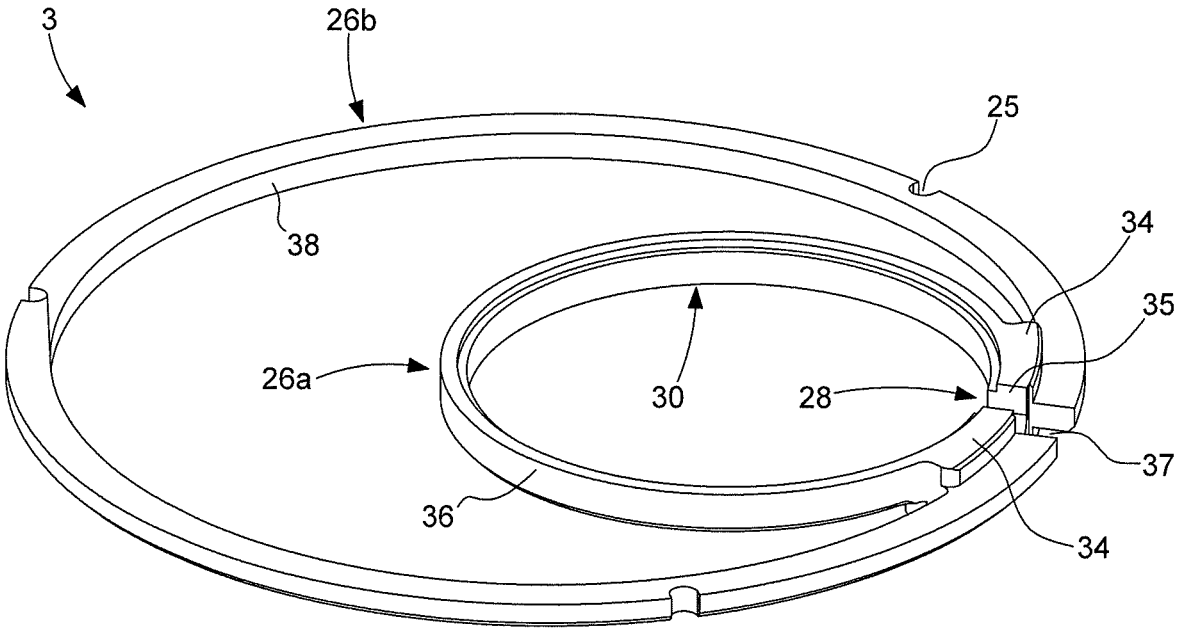
FIG. 5 is a perspective top view of the casing ring of FIG. 1.
Figure 6:
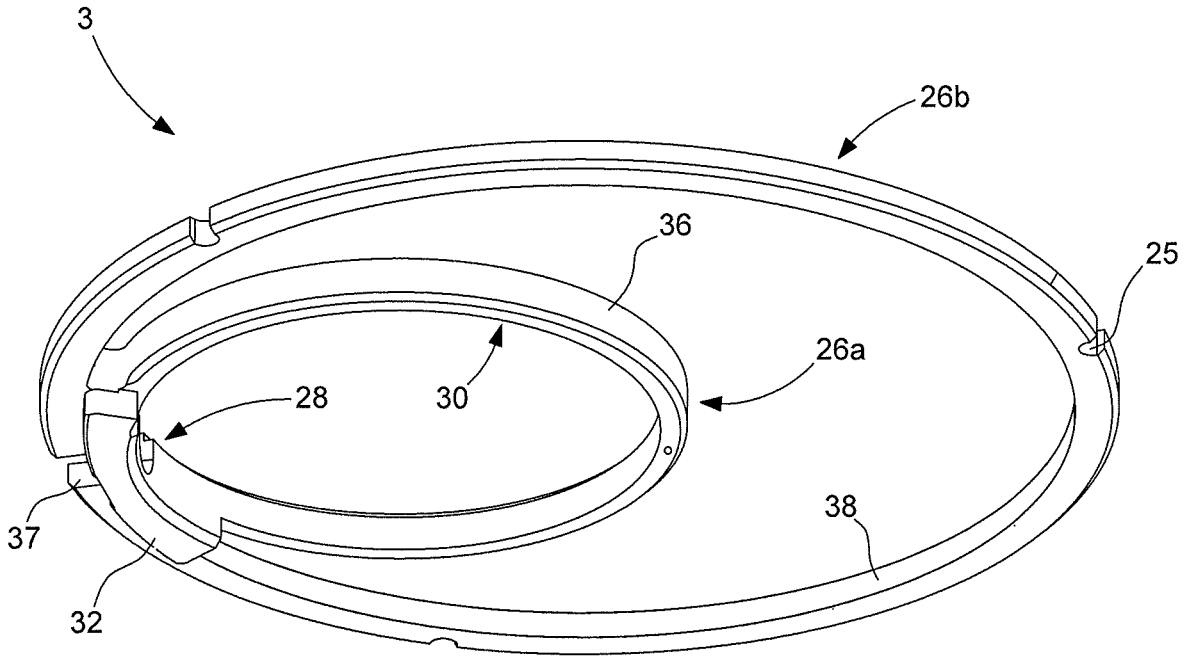
FIG. 6 is a perspective bottom view of the casing ring of FIG. 1.

As illustrated in FIGS. 5 and 6, first inner ring 26*a* has a first portion 28 and a second portion 30. First portion 28 includes, for example, a lower rim 32 and two upper reinforcing rims 34. Lower rim 32 and upper rims 34 are thus used to reinforce casing ring 3, giving the assembly rigidity. The two upper rims 34 are separated from each other by a space 35 for the passage of winding stem 18. A corresponding gap 37 is provided on second outer ring 26*b* for the passage of winding stem 18.

Preferably, at least one of the two rings 26*a*, 26*b* has a satin-finished inner or outer face. In the illustrative example of FIGS. 5 and 6, first inner ring 26*a* has a satin-finished outer face 36, and second outer ring 26*b* has a satin-finished inner face 38.

The configuration of casing ring 3 according to the first embodiment of the invention of FIGS. 1 to 6 and of the other elements of watch 1 allows dials 8*a*, 8*b* to be precisely positioned with respect to one another. Indeed, starting with given dimensions for the support rims of ring 3 for dials 8*a*, 8*b*, it is possible to adjust the height of collar 6*a* of movement 6 and the dimensions of flange 27 in particular, in order to obtain coplanarity for upper surfaces 24*a*, 24*b* of the two dials 8*a*, 8*b*.

In a second embodiment of the invention, not represented in the Figures, casing ring 3 is shaped such that the upper surfaces of the two dials 8*a*, 8*b* are located at different heights inside watch case 2.

In other embodiments, not represented in the Figures, watch 1 can include at least one decorative part, for example a three dimensional part. Such a decorative part is then secured to casing ring 3 inside watch case 2.

The preceding description of the watch according to the invention was made with reference to a first dial 8*a* which is a time dial, and to a second dial 8*b* which is a decorative dial. However, those skilled in the art will understand that these particular types of dials are not limiting within the context of the present invention and that, in practice, any type of dial can be used for either of the two dials 8*a*, 8*b*.

The invention claimed is:

1. A watch comprising a watch case, the watch case containing a watch movement and two dials;

wherein the watch further comprises a casing ring arranged inside the watch case, the watch movement being mounted in the casing ring so as to be suspended in a cantilever arrangement inside the watch case, said casing ring supporting the two dials, and one of the two dials circumscribes the other dial inside the watch case.

2. The watch according to claim 1, wherein the two dials have upper surfaces, the casing ring having a shape such that the upper surfaces of the two dials are coplanar.

3. The watch according to claim 1, wherein both dials have upper surfaces and the casing ring is shaped such that the upper surfaces of the two dials are located at different heights inside the watch case.

4. The watch according to claim 1, wherein the watch case is provided with a case middle and means for securing the casing ring to the case middle.

5. The watch according to claim 4, wherein the securing means are screws positioned on the edge of the casing ring, one of the two dials being arranged on the casing ring and being provided on its edge with notches for receiving screw heads, such that said screws at the same time secure said dial to the casing ring.

6. The watch according to claim 1, wherein one of the two dials is a decorative dial with a plique-à-jour.

7. The watch according to claim 1, wherein the watch further comprises at least one decorative part, the decorative part being secured to the casing ring inside the watch case.

8. The watch according to claim 1, wherein the casing ring comprises two eccentric integral rings, the watch movement being mounted in a first inner ring, the first inner ring supporting one of the two dials, a second outer ring supporting the other of the two dials.

9. The watch according to claim 8, wherein the first inner ring has a satin-finished outer face, and second outer ring has a satin-finished inner face.

10. A watch comprising a watch case, the watch case containing a watch movement and two dials;

wherein the watch further comprises a casing ring arranged inside the watch case, the watch movement being mounted in the casing ring so as to be suspended in a cantilever arrangement inside the watch case, said casing ring supporting the two dials, and wherein the casing ring comprises two eccentric integral rings, the watch movement being mounted in a first inner ring, the first inner ring supporting one of the two dials, a second outer ring supporting the other of the two dials.

* * * * *